US010301134B2

(12) United States Patent
Gnan

(10) Patent No.: US 10,301,134 B2
(45) Date of Patent: May 28, 2019

(54) SPLICE ARRANGEMENT

(71) Applicant: BHS Corrugated Maschinen- und Anlagenbau GmbH, Weiherhammer (DE)

(72) Inventor: Alfons Gnan, Vilseck (DE)

(73) Assignee: BHS Corrugated Maschinen- und Anlagenbau GmbH, Weiherhammer (DE)

( * ) Notice: Subject to any disclaimer, the term of this patent is extended or adjusted under 35 U.S.C. 154(b) by 83 days.

(21) Appl. No.: 15/476,028

(22) Filed: Mar. 31, 2017

(65) Prior Publication Data

US 2017/0297849 A1 Oct. 19, 2017

(30) Foreign Application Priority Data

Apr. 15, 2016 (DE) ..... 10 2016 206 446

(51) Int. Cl.

| | |
|---|---|
| ***B65H 19/14*** | (2006.01) |
| ***B65H 16/02*** | (2006.01) |
| ***B65H 19/18*** | (2006.01) |
| ***B65H 19/20*** | (2006.01) |
| ***B65H 21/00*** | (2006.01) |
| ***B65H 23/08*** | (2006.01) |

(Continued)

(52) U.S. Cl.

CPC ..... *B65H 19/14* (2013.01); *B65H 16/021* (2013.01); *B65H 19/18* (2013.01); *B65H 19/1852* (2013.01); *B65H 19/1873* (2013.01); *B65H 19/20* (2013.01); *B65H 21/00* (2013.01); *B65H 23/08* (2013.01); *B65H 23/10* (2013.01); *B65H 23/1888* (2013.01); *B65H 2408/2171* (2013.01); *B65H 2511/112* (2013.01); *B65H 2513/11* (2013.01); *B65H 2515/31* (2013.01)

(58) Field of Classification Search

CPC ..... B65H 19/14; B65H 19/18; B65H 19/20; B65H 19/1852; B65H 19/1873

See application file for complete search history.

(56) References Cited

U.S. PATENT DOCUMENTS 3,841,944 A * 10/1974 Harris, Jr. ..... B65H 19/1852 156/159

4,065,067 A 12/1977 Martinez (Continued)

FOREIGN PATENT DOCUMENTS

DE 27 56 239 A1 7/1978
DE 38 39 688 A1 5/1990

(Continued)

*Primary Examiner* — Sang K Kim
(74) *Attorney, Agent, or Firm* — McGlew and Tuttle, P.C.

(57) ABSTRACT

A splice arrangement includes an unwinding arrangement for unwinding a finite first material web from a first material roll or a finite second material web from a second material roll, a braking arrangement for applying a braking force to the unwinding arrangement and/or the finite material web being unwound, a connection arrangement for connecting the finite material webs to form an endless material web, a storage trolley for the uninterrupted conveying of the endless material web, at least one material web tension-influencing device arranged before the storage trolley, and an actuation device, which is in signal connection with the at least one material web tension-influencing device for actuating the same.

19 Claims, 1 Drawing Sheet

(51) Int. Cl.
*B65H 23/10* (2006.01)
*B65H 23/188* (2006.01)

(56) References Cited

U.S. PATENT DOCUMENTS

| | | | | |
|---|---|---|---|---|
| 4,169,752 | A | 10/1979 | Tokuno | |
| 4,170,506 | A | 10/1979 | Marschke | |
| 2012/0211142 | A1* | 8/2012 | Casey | B26D 1/305 156/64 |

FOREIGN PATENT DOCUMENTS

| | | | |
|---|---|---|---|
| EP | 0 521 159 | A1 | 1/1993 |
| EP | 1 609 749 | A1 | 12/2005 |
| EP | 1 801 058 | A2 | 6/2007 |
| WO | 93/18994 | A1 | 9/1993 |

* cited by examiner

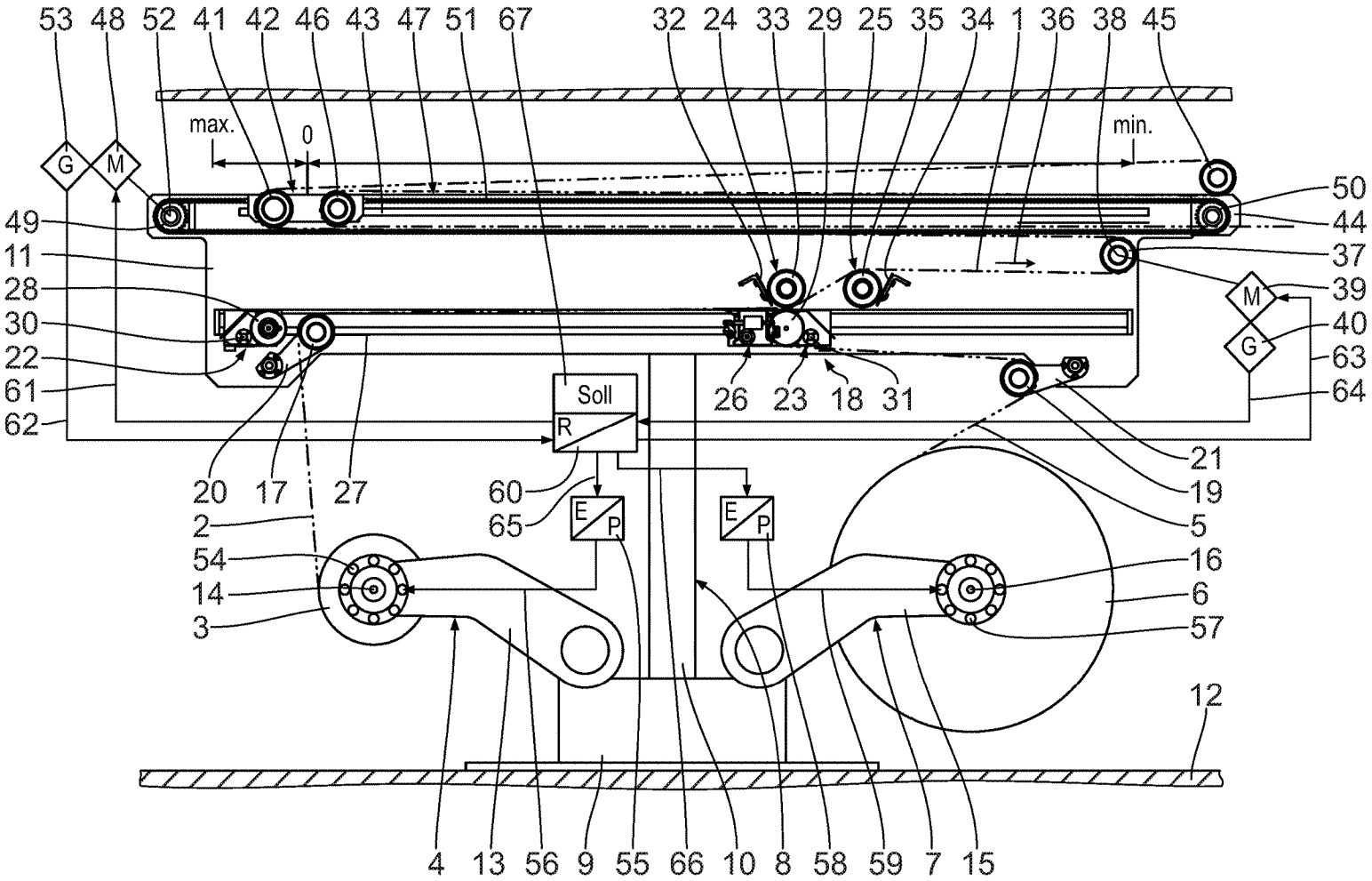
min.
max.
0
Soll
R
E
P
M
G

SPLICE ARRANGEMENT

CROSS REFERENCE TO RELATED APPLICATIONS

This application claims the benefit of priority under 35 U.S.C. § 119 of German patent application 10 2016 206 446 filed Apr. 15, 2016, the entire contents of which are incorporated herein by reference.

FIELD OF THE INVENTION

The invention concerns a splice arrangement for splicing material webs.

BACKGROUND OF THE INVENTION

Known splice arrangements connect a finite material web that is coming to an end with a new finite material web, so that an endless material web is quasi created. This process is called splice or splicing in expert terms and a corresponding arrangement is known as splice or splicing arrangement. With the known splice arrangements of prior art faults often occur, which can lead to a production stop. It can also happen that the splice connection produced between the material webs during the splice process is not optimal or particularly durable.

A device for connecting paper webs is known from DE 27 56 239 A1. DE 38 39 688 A1 discloses a device for splicing webs.

SUMMARY OF THE INVENTION

The invention is therefore based on the task of providing a splice arrangement that allows a particularly easy and functionally safe splicing of material webs. A corresponding method should also be provided.

This task is solved in accordance with the invention by a splice arrangement for splicing material webs, comprising an unwinding arrangement for unwinding a finite first material web from a first material roll or a finite second material web from a second material roll, a braking arrangement for applying a braking force to the unwinding arrangement and/or the finite material web being unwound, a connection arrangement for connecting the finite first material web and the finite second material web to form an endless material web during a splice process, a storage trolley for the uninterrupted conveying of the endless material web, at least one material web tension-influencing device arranged before the storage trolley for influencing a web tension of the endless material web, and an actuation device, which is in signal connection with the at least one material web tension-influencing device for actuating the same, and by a method for splicing finite material webs, in particular by means of a splice arrangement according to the invention, comprising the steps: unwinding a finite first material web from a first material roll or a finite second material web from a second material roll by means of an unwinding arrangement, applying a braking force to the unwinding arrangement and/or to the finite material web being unwound by means of a braking arrangement, connecting the finite first material web and the finite second material web during a splice process to form an endless material web by means of a connection arrangement, influencing a web tension of the endless material web by means of at least one material web tension-influencing device located before a storage trolley, and actuating the at least one material web tension-influencing device by means of an actuation device. The core lies in that the web tension of the endless material web can be influenced in a targeted way in the splice arrangement with the at least one material tension-influencing device, which in turn favorably results in a displacement of the storage trolley or a position regulation, and therefore a change in the storage quantity of the endless material web in the splice arrangement.

The web tensioning of the endless material web favorably remains substantially constant in the splice arrangement even when the position of the storage trolley or the storage quantity of the stored endless material web in the splice arrangement is changed.

It is expedient if the splice arrangement is part of a corrugator for manufacturing a corrugated board web with the endless material web produced in the splice arrangement.

It is of advantage if the unwinding arrangement comprises a first unwinding unit for unwinding a finite first material web from a first material roll, and a second unwinding unit for unwinding a finite second material web from a second material roll.

The braking arrangement preferably has a first braking unit for applying a first braking force to the active first unwinding unit and/or to the first finite material web being unwound and/or a second braking unit for applying a second braking force to the active second unwinding unit and/or to the second finite material web being unwound.

It is of advantage if the first braking force is selected in such a way when the first unwinding unit is active that the web tension of the finite first material web prevailing in the first unwinding unit is greater, preferably substantially greater than a target web tension of the endless material web on the storage trolley.

The second braking force is favorably selected in such a way when the second unwinding unit is active that the web tension of the finite second material web prevailing in the second unwinding unit is greater, preferably substantially greater than a target web tension of the endless material web on the storage trolley.

The connection arrangement favorably comprises a first preparation means, a second preparation means, a first connection means for connecting a web end of the finite first material web with a web start of the finite second material web, a second connection means for connecting a web end of the finite second material web with a web start of the finite first material web and a table unit for cooperation with the preparation means and the connection means.

The storage trolley is favorably, in particular directly and or indirectly, displaceable. It is expedient if the position of the storage trolley has an influence on the storage quantity of the stored endless material web in the splice arrangement. By displacing the storage trolley the storage quantity of the endless material web can favorably be increased or reduced in the splice arrangement.

The web tension of the endless material web can be increased, reduced or held constant in the splice arrangement, in particular with the at least one material web tension-influencing device, depending on what is required or stipulated at the time.

It is expedient if the at least one material web tension-influencing device is located downstream from the connection arrangement, in particular in a transport direction of the endless material web. The at least one material web tension-influencing device is favorably arranged between the storage trolley and the connection arrangement, in particular with regard to the transport direction of the endless material web.

It is of advantage if the actuation device is an electrical or electronic type. It is favorably designed as a regulator.

The signal connection between the actuation device and the at least one material web tension-influencing device is favorably wireless or wired.

It is of advantage of the finite first material web and the finite second material web are finite paper webs. A waved corrugated board web or a smooth corrugated board web can for example be produced from these.

The design in which the braking force is selected in such a way that the web tension of the respective material web being unwound that prevails at the unwinding unit is greater than a target web tension of the endless material web at the storage trolley leads to a functionally particularly safe and simple handling of the material web being unwound. This is tensioned particularly well or evenly, which simplifies its handling and processing. The braking arrangement preferably overbrakes.

The design in which the at least one material web tension-influencing device balances a difference between the web tension of the respective finite material web prevailing at the unwinding unit and a target web tension of the endless material web at the storage trolley also leads to an unwinding material web that is always particularly well or evenly tensioned, which simplifies its handling and processing.

According to one embodiment the splice arrangement comprises a storage trolley displacement device for displacing the storage trolley. The storage trolley displacement device preferably engages the storage trolley directly or indirectly. It is for example integrated into the storage trolley itself. Alternatively the storage trolley displacement device is for example an external storage trolley displacement device and engages the storage trolley from the outside. The storage trolley displacement device is favorably an electric, pneumatic and/or hydraulic type.

The at least one storage trolley displacement drive of the storage trolley displacement device, favorably comprises at least one storage trolley displacement motor. It is preferably a rotary drive or gear drive. Other drives can be used as alternatives.

The storage trolley displacement device favorably comprises at least one coupling element for coupling the at least one storage trolley displacement drive with the storage trolley, wherein the at least one coupling element is preferably designed as an endless coupling element. This storage trolley displacement device is extremely functionally safe and economic. It is of advantage if the at least one coupling element is designed as a band, chain, rope or suchlike.

A torque of the at least one storage trolley displacement drive favorably equals a target value parameter during operation.

The signal connection between the actuation device and the storage trolley displacement device for actuating the same is favorably wired or wireless.

The respective position of the storage trolley can be recorded particularly easily and functionally safe with the at least one position sensor for recording said respective position of the storage trolley, wherein the at least one material web tension-influencing device actuates the storage trolley depending on the recorded position of the storage trolley. The respective position of the storage trolley is preferably directly and/or indirectly recordable.

The at least one material web tension-influencing device favorably actuates the storage trolley when the same is at a distance from its zero position or its target position. The at least one material web tension-influencing device preferably actuates the storage trolley indirectly, in particular via the endless material web.

According to one embodiment the storage trolley can be displaced by changing the web tension of the endless material web in the splice arrangement by means of at least one material web tension-influencing device, which is also capable of holding the storage trolley in its zero position. If necessary the at least one material tension-influencing decide is capable of changing the web tension of the endless material web. A change in the web tension of the endless material web in the splice arrangement by the at least one material web tension-influencing device for example leads to a displacement of the storage trolley from its zero position or target position. By changing the web tension of the endless material web in the splice arrangement with the at least one material web tension-influencing device the storage trolley can in particular also be returned to its zero position or target position.

According to one embodiment the at least one material web tension-influencing device comprises at least one brakeable and/or acceleratable material web tension-influencing roller for engaging the endless material web, on which parts of the endless material web lie.

When the rotation speed of the at least one material web tension-influencing roller is greater than the currently prevailing transport speed of the endless material web at this material web tension-influencing roller, this will lead to a reduction in the web tension of the endless material web, either there or downstream from the same.

If the rotation speed of the at least one material web tension-influencing roller is lower than the currently prevailing transport speed of the endless material web at this material web tension-influencing roller, this leads to an increase in the web tension of the endless material web there or downstream.

If the rotation speed of the at least one material web tension-influencing roller equals that of the currently prevailing transport speed of the endless material web at this material web tension-influencing roller, the web tension of the endless material web remains unchanged there or downstream.

The at least one material web tension-influencing roller is favorably arranged after the connection arrangement, in particular in transport direction of the endless material web. It is favorably arranged before the storage trolley, in particular in transport direction of the endless material web.

The at least one roller drive, which is in connection with the at least one material web tension-influencing roller for accelerating and/or braking the at least one material web tension-influencing roller, engages the at least one material web tension-influencing roller preferably directly or indirectly. It is favorably designed as an electric drive. It is of advantage of the at least one roller drive is a rotary drive. The at least one roller drive is in particular capable of increasing, reducing or holding the rotation speed of the at least one material web tension-influencing roller constant.

According to one embodiment, the at least one rotation speed sensor is preferably capable of recording the rotation speed of the at least one roller drive and/or the at least one material web tension-influencing roller directly and/or indirectly.

The signal connection between the actuation device and the braking arrangement for actuating the same is favorably a wireless or wired signal connection. In particular the actuation device is in signal connection with the first braking unit and/or second braking unit. Corresponding signals can be sent from the actuation device to the braking arrangement, i.e. to the first or second braking unit, in this way.

A preferred embodiment of the invention will be described hereafter by way of an example.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The single FIGURE shows a simplified side view of a splice arrangement according to the invention.

DESCRIPTION OF THE PREFERRED EMBODIMENTS

A corrugator (not shown in its entirety) comprises a known corrugated board production device (not shown) for manufacturing a corrugated board web laminated on one side (not shown). Such a corrugated board production device is generally known as a single facer.

The corrugated board production device comprises a corrugating means with corrugated rollers for producing a corrugated web with a corrugation from a material web. The corrugated board production device comprises a glue application means for connecting the corrugated web with a smooth web, which applies glue to the peaks of the corrugation of the corrugated web. The corrugated board production device has a pressing module for pressing the smooth web against the corrugated web equipped with glue, where the corrugated web laminated on one side is created from the corrugated web and the smooth web.

A first splice arrangement for providing an endless material web 1 and a further splice arrangement (not shown) for providing a further endless material web (not shown) are arranged before the corrugated web production device. The corrugated web can be created from the endless material web 1 and forms a part of the corrugated board web laminated on one side, which is also endless. Alternatively the endless material web 1 forms the smooth web of the corrugated board web laminated on one side.

The smooth web is also endless. The corrugated board web laminated on one side can be laminated with a further endless smooth web or a corrugated board web laminated on one side. The further smooth web can be formed by the endless material web 1.

As the two splice arrangements are preferably identical, only one of the splice arrangements will hereafter be described in detail with reference to the single FIGURE. Its construction will be explained first.

The illustrated splice arrangement comprises a first unwinding unit 4 for unwinding a finite first material web 2 from a first material roll 3, and a second unwinding unit 7 for unwinding a finite second material web 5 from a second material roll 6. The first unwinding unit 4 and the second unwinding unit 7 together form an unwinding arrangement.

The finite first material web 2 and the finite second material web 5 are firmly connected with each other for providing the endless material web 1 by means of the splice arrangement, preferably with an adhesive tape.

The splice arrangement has a base frame 8 with a base frame plinth 9, a base frame stand 10 and a base frame support 11. The base frame plinth 9 is fixed on/to a floor or ground 12. The base frame stand 10 is fitted at top of the base frame plinth 9. The base frame stand 10 extends substantially vertically or perpendicular to the floor 12. The base frame support 11 is arranged in an end area of the base frame stand 10 opposite the base frame plinth 9 and extends substantially parallel to the floor 12, or horizontally.

The first unwinding unit 4 and the second unwinding unit 7 extend starting from the base frame plinth 9. The unwinding units 4, 7 are pivotably mounted on the base frame plinth 9 and arranged relative to the base frame stand 10 to face each other.

The first unwinding unit 4 comprises a first receiving part (not shown) for receiving the first material roll 3, which is guided into a central opening of the first material roll 3 and mounted between two first holding arms 13 of the first unwinding unit 4 extending parallel to each other, around a first axis of rotation 14.

The second unwinding unit 7 is designed like the first unwinding unit 4. It comprises a second receiving part (not shown) for receiving the second material roll 6, which is guided into a central opening of the second material roll 6 and mounted between two second holding arms 15 of the second unwinding unit 7 extending parallel to each other, around a second axis of rotation 16. The axes of rotation 14, 16 extend horizontally and parallel to each other.

The first unwinding unit 4 also comprises a first braking unit 54, which is capable of applying a first braking force to the first material roll 3. The first braking unit 54 is a pneumatic braking unit and can be actuated via a first electro-pneumatic actuator 55 connected with the first braking unit 54 via a first line 56.

The second unwinding unit 7 further comprises a second braking unit 57, which is capable of applying a second braking force to the second material roll 6. The second braking unit 57 is a pneumatic braking unit and can be actuated via a second electro-pneumatic actuator 58 connected with the second braking unit 57 via a second line 59. Other braking units 54, 57 and actuators 55, 58 can be used as alternatives.

The finite first material web 2 can be supplied to the splice arrangement via a first supply roller 17 of a cutting and connection arrangement 18, whilst the finite second material web 5 can be supplied via a second supply roller 19 of the cutting and connection arrangement 18.

Each supply roller 17, 19 is rotatably mounted on a first or second support arm 20, 21 which is pivotably mounted on the base frame support 11 above\the respective material roll 3 or 6 to tensioning the respective finite material web 2 or 5.

The cutting and connection arrangement 18 serves for producing the endless material web 1 from the finite material webs 2, 5. It comprises a first preparation means 22, a second preparation means 23, a first connection means 24, a second connection means 25 and a table unit 26 as well as a guide 27.

With the illustrated splice arrangement the first unwinding unit 4 is currently active, so that the first finite material web 2 is unwound from the first material roll 3 and comes to an end at some point. According to the FIGURE the first preparation means 22 is currently located on the base frame support 11 in a first end area of the guide 27 adjacent to the first supply roller 17, whilst the second preparation means 23 is currently located on the base frame support 11 at a distance from a second end area of the guide 27 opposite the first end area according to the FIGURE. The second end area of the guide 27 extends adjacent to the second supply roller 19.

The guide 27 extends straight in/on the base frame support 11 and parallel to the floor 12, wherein the preparation means 22, 23 can be displaced along the guide 27.

The table unit 26 is also displaceable along the guide 27. It is arranged between the two preparation means 22, 23. The preparation means 22, 23 and the table unit 26 are displaceable along the guide 27 and relative to the preparation means 24, 25.

The connection means 24, 25 are arranged at distances from each other along the guide 27. They are arranged on the base frame support 11 above the guide 27.

The preparation means 22, 23 are constructed identically and arranged symmetrically in relation to a vertically extending symmetrical plane.

The first preparation means 22 comprises a rotatably mounted first adhesion roller 28 for supplying the finite first material web 2. The first adhesion roller 28 is preferably equipped with an adhesion layer for holding and supplying the finite first material web 2, and can be displaced along the guide 27 for transporting the finite first material web 2 to the first or second connection means 24, 25.

The second connection means 23 comprises a rotatably mounted second adhesion roller 29 for supplying the finite second material web 5. The second adhesion roller 29 is preferably equipped with an adhesion layer for holding and supplying the finite second material web 5, and can be displaced along the guide 27 for transporting the finite second material web 5 to the first or second connection means 24, 25.

Each preparation means 22, 23 comprises its own first or second\displacement drive 30, 31 for their displacement along the guide 27.

The connection means 24, 25 are constructed identically and arranged symmetrically on the base frame support 11 in relation to a vertically extending symmetrical plane.

The first connection means 24 comprises a first cutting unit with an actuatable first cutting blade 32 for cutting the finite first material web 2 prior to connection with the finite second material web 5 and a first pressing roller 33 for connecting the finite material webs 2, 5 with the endless material web 1. The first cutting unit and the first pressing roller 33 are fixed to the base frame support 11 immediately adjacent to the guide 27 in such a way that the adhesion rollers 28, 29 of the preparation means 22, 23 and the table unit 26 can be guided along the guide 27 past the first connection means 24.

The second connection means 25 comprises a second cutting unit with an actuatable second cutting blade 34 for cutting the finite second material web 5 prior to connection with the finite first material web 2 and a second pressing roller 35 for connecting the finite material webs 2, 5 with the endless material web 1. The second cutting unit and the second pressing roller 35 are fixed to the base frame support 11 immediately adjacent to the guide 27 in such a way that the adhesion rollers 28, 29 of the preparation means 22, 23 and the table unit 26 can be guided past the guide 27 on the second connection means 25.

When the first adhesion roller 28 is located in a position adjacent to the second pressing roller 35, it delimits a first connection gap for passing through the finite material webs 2, 5 to be connected and a first adhesive tape, which is preferably adhesive on both sides has previously been manually attached accordingly to a web start of the finite first material web 2 for connection with the finite second material web 5 or the endless material web 1. The finite material webs 2, 5 are connected with each other with glue here.

When the second adhesion roller 29 is located in a position adjacent to the first pressing roller 33, it delimits a second connection gap for passing through the finite material webs 2, 5 to be connected and a second adhesive tape, which is preferably adhesive on both sides has previously been manually attached accordingly to a web start of the finite second material web 5 for connection with the finite first material web 2 or the endless material web 1. The finite material webs 2, 5 are connected with each other with glue here.

The table unit 26 acts with the first preparation means 22, the second preparation means 23, the first connection means 24 or the second connection means 25 depending on its respective position and is displaceable, in particular also independently from the same, along the guide 27.

A material web tension-influencing roller 37 is arranged after the cutting and connection arrangement 18 in a transport direction 36 of the endless material web 1, which is rotatably or rotation driveably mounted in the area of the second material roll 6 or the second supply roller 19 at the top of the base frame support 11. The endless material web 1 is guided around the material web tension-influencing roller 37 and partially lies on the outside of the same. The material web tension-influencing roller 37 diverts the endless material web 1. The material web tension-influencing roller 37 is rotatable or rotation driveable around an axis of rotation 38 extending parallel to the axes of rotation 14, 16.

A rotation speed of the material web tension-influencing roller 37 around the axis of rotation 38 is changeable. The material web tension-influencing roller 37 is in indirect or direct drive connection with a roller drive 39 for this. The roller drive 39 is capable of increasing, reducing or holding the rotation speed of the material web tension-influencing roller 37 constant, depending on what the relevant application case demands. We will explain this in detail hereafter.

A rotation speed sensor 40 is associated with the roller drive 39. The rotation speed sensor 40 is capable of recording the respective rotation speed of the roller drive 39, in particular of its drive shaft.

The material web tension-influencing roller 37 and the roller drive 39 are parts of a material web tension-influencing device.

A first deflection roller 41 is arranged after the material web tension-influencing roller 37 in the transport direction 36 of the endless material web 1, which is rotatably mounted on a storage trolley 42.

The storage trolley 42 is arranged in the area of an upper end of the base frame support 11 facing away from the base frame stand 10 and is displaceable along a storage trolley guide 43, which extends parallel to the floor 12 and above the guide 27. The storage trolley guide 43 prescribes a displacement path for the storage trolley 42 and substantially extends along the entire base frame support 11.

The storage trolley 42 is here displaceable between a first end area and a second end area of the storage trolley guide 43. It is displaceable in opposing displacement directions. The storage trolley 42 is arranged in the second end area adjacent to a material web outlet 44 and the storage quantity of the stored endless material web 1 is minimal when the storage trolley 42 is located in the first end area at a distance or removed from the material web outlet 44, and the storage quantity of the stored endless material web 1 is maximal. In the FIGURE the storage trolley 42 is located adjacent to the first end area in its zero position. The storage trolley 42 can be displaced in opposing displacement direction from its zero position.

A second deflection roller 45 is rotatably mounted on the base frame support 11 in the area of the material web outlet 44 for deflecting the endless material web 1. The second deflection roller 45 is arranged after the first deflection roller 41 in the transport direction 36 of the endless material web 1.

A third deflection roller 46 is arranged after the second deflection roller 45 in the transport direction 36 of the endless material web 1, which is rotatably mounted between the first deflection roller 41 and the second deflection roller 45 on the storage trolley 42. The axes of rotation of the deflection rollers 41, 45, 46 extend horizontally and parallel to the axis of rotation 38 of the material web tension-influencing roller 37.

A storage trolley displacement device 47 firstly serves for displacing the storage trolley 42 along the storage trolley guide 43. The storage trolley displacement device 47 is arranged on the base frame support 11. It comprises a storage trolley displacement drive 48. The storage trolley displacement device 47 further comprises a drive gear 49, which is rotation driveably mounted in/on the base frame support 11 near the first end area of the storage trolley guide 43 and is in drive connection with the storage trolley displacement drive 48. The storage trolley displacement device 47 also has a deflection gear 50 that is rotatably mounted adjacent to the second end area of the storage trolley guide 43 on the base frame support 11. A in particular circumferentially closed drive chain 51 of the storage trolley displacement device 47 guided around the drive gear 49 and the deflection gear 50 is in connection with the storage trolley 42 or is fitted to the same.

A rotary drive of the drive gear 49 around the axis of rotation 52 of the same through the storage trolley displacement drive 48 leads to a circumferential displacement of the drive chain 51, which in turn effects a displacement of the storage trolley 42 along the storage trolley guide 43. Depending on the rotation direction of the storage trolley displacement drive 48 or its drive shaft or the drive gear 49 the storage trolley 42 is either displaced in the direction of the second end area of the storage trolley guide 43, or is displaced away from the same along the storage trolley guide 43.

A position sensor 53 for recording the respective position of the storage trolley 42 along the storage trolley guide 43 is associated with the storage trolley displacement drive 48. Alternatively the position sensor 53 is associated directly with the storage trolley 42 for recording its position.

The splice arrangement further comprises an overriding electronic regulator 60. The regulator 60 has a target value stipulation unit 67 for stipulating target values, in particular for the roller drive 39 and the storage trolley displacement drive 48.

The regulator 60 is in signal connection with the storage trolley displacement drive 48 via a first signal line 61 and is capable of correspondingly controlling the storage trolley displacement drive 48 for a corresponding displacement of the storage trolley 42 along the storage trolley guide 43 via the first signal line 61 when in use.

The regulator 60 is in signal connection with the position sensor 53 via a second signal line 62 and receives position signals from the position sensor 53 via the second signal line 62 when in use, which reflect the respective position of the storage trolley 42 along the storage trolley guide 43.

The regulator 60 is also in signal connection with the roller drive 39 via a third signal line 63 and is capable of correspondingly controlling the roller drive 39 for rotatably driving the material web tension-influencing roller 37 via the third signal line 63 when in use.

The regulator 60 is also in signal connection with the rotation speed sensor 40 via a fourth signal line 64 and receives rotation speed signals of the rotation speed sensor 40, which reflect the respective rotation speed of the roller drive 39, via the fourth signal line 64 when in use.

The regulator 60 is in signal connection with the first electro-pneumatic actuator 55 via a fifth signal line 65 and is capable of correspondingly controlling the first electro-pneumatic actuator 55 for actuating the first braking unit 54 via the fifth signal line 65 when in use.

The regulator 60 is in signal connection with the second electro-pneumatic actuator 58 via a sixth signal line 66 and is capable of correspondingly controlling the second electro-pneumatic actuator 58 for actuating the second braking unit 57 via the sixth signal line 66 when in use.

The signal lines 61 to 66 are alternatively designed as wireless signal connections.

Use of the splice arrangement will be described in more detail hereafter.

The first unwinding unit 4 is currently active in the FIGURE. The finite first material web 2 is unwound from the first material roll 3 and conveyed in this way. It is supplied to the cutting and connection arrangement 18 via the first supply roller 17, where the finite first material web 2 is deflected by approximately 90°. The finite first material web 2 is passed between the second adhesion roller 29 and the first pressing roller 33. The finite first material web 2 is also passed between the pressing rollers 33, 35 located at a distance from each other and partially lies on the circumference of the same.

After the cutting and connection arrangement 18 the finite first material web 2 or the endless material web 1 is guided around the material web tension-influencing roller 37 and deflected by approximately 180° there. The endless material web 1 is then supplied to the first deflection roller 41, where it is again deflected by approximately 180°. After the first deflection roller 41 the endless material web 1 is guided around the second deflection roller 45, where it is again deflected by approximately 180°. The endless material web 1 is then guided around the third deflection roller 46, where it is once again deflected by approximately 180° and supplied to the material web outlet 44. The endless material web 1 leaves the splice arrangement at the material web outlet 44.

The first preparation means 22 is located adjacent to the first supply roller 17 or near the first end area of the guide 27.

The finite second material web 5 is held in a waiting position by the cutting and connection arrangement 18 or the second adhesion roller 29, so that this can be connected with the finite first material web 2 to form the endless material web 1 if required. This is in particular realized when the finite first material web 2 comes to an end. The second unwinding unit 7 is therefore inactive. The finite second material web 5 is not currently being unwound from the second material roll 6 or conveyed.

The first braking unit 54 applies a first braking force to the first material roll 3 to ensure that the finite first material web 2 or the endless material web 1 has sufficient web tension. The regulator 60 correspondingly controls the first electro-pneumatic actuator 55 for this. The first braking force is selected in such a way that the web tension of the first material web 2 being unwound by the first unwinding unit 4 is greater than a target web tension of the endless material web 1 on the storage trolley 42.

The storage trolley 42 is normally located in its zero position, which is also shown in the FIGURE. However, it is possible that the web tension of the endless material web 1 changes during operation of the splice arrangement or the corrugator, which leads to an automatic or independent displacement of the storage trolley 42 along the storage trolley guide 43, and therefore also to an automatic or independent change in the storage quantity of the endless material web 1 in the splice arrangement.

If the web tension of the endless material web 1 on the storage trolley 42 for example increases, the storage trolley 42 will automatically or independently be pulled in the direction of the second end area of the storage trolley guide 43 by this, which reduces the storage quantity of the endless material web 1 in the splice arrangement.

Such a displacement of the storage trolley 42 in the direction of the second end area of the storage trolley guide 43 also leads to an increase in the web tension of the endless material web 1 in the splice arrangement. Once the web tension of the endless material web 1 has increased above the external web tension of the endless material web 1, the storage trolley 42 therefore automatically or independently drives back to its zero position.

When the web tension of the endless material web 1 in the splice arrangement increases, the first braking force is also reduced by the first braking unit 54, which can be achieved with a corresponding actuation of the first electro-pneumatic actuator 55. The storage trolley 42 thus returns to its zero position.

When the web tension of the endless material web 1 for example reduces at the storage trolley 42, the storage trolley 42 will be automatically or independently moved away from the second end area of the storage trolley guide 43 by this, which increases the storage quantity of the endless material web 1 in the splice arrangement.

A displacement of the storage trolley 42 away from the second end area of the storage trolley guide 43 will also lead to a reduction in the web tension of the endless material web 1 in the splice arrangement. When the web tension of the endless material web 1 falls below the external web tension of the endless material web 1 due to this, the storage trolley 42 will automatically or independently return to its zero position.

When the web tension of the endless material web 1 in the splice arrangement is reduced, the first braking force is also increased by the braking unit 54, which can be achieved with a corresponding actuation of the first electro-pneumatic actuator 55. The storage trolley 42 thus returns to its zero position.

The first braking force is favorably selected in such a way that the web tension of the finite first material web 2 is greater at the first unwinding unit 4 than at the web tension of the finite first material web 2 or the endless material web 1 desired at the storage trolley 42.

As mentioned, the web tension of the endless material web 1 in the splice arrangement can also be influenced by the material web tension-influencing roller 37, which finally leads to a corresponding displacement of the storage trolley 42 along the storage trolley guide 43, as stated above. The storage trolley 42 can be held in its zero position in this way.

The respective position of the storage trolley 42 is dependent on the drive of the material web tension-influencing roller 37, which engages the endless material web 1 in a driving or braking way for changing the web tension of the endless material web 1 in the splice arrangement for guiding the storage trolley 42 into its zero position. The position regulation of the storage trolley 42 can therefore be changed independently from the storage trolley displacement device 47.

The rotation speed of the material web tension-influencing roller 37 is favorably calculated depending on the storage quantity of the endless material web 1 in the splice arrangement. The desired web tension of the endless material web 1 at the storage trolley 42 is favorably generated only by the material web tension-influencing roller 37.

The material web tension-influencing roller 37 is driven in such a way that a difference between the web tension of the finite first material web 2 being unwound and a target web tension of the endless material web 1 prevailing at the first unwinding unit 4 is balanced at the storage trolley 42.

The web tension of the endless material web 1 in the splice arrangement also remains substantially unchanged in this way during a displacement of the storage trolley 42 along the storage trolley guide 43, for example during a splice process. Differences in the web tension of the endless material web 1 are extremely small during the operation of the splice arrangement.

The storage trolley displacement drive 48 is favorably subjected to a target torque. The torque of the storage trolley displacement drive 48 in particular equals a target stipulation from the regulator 60. The rotation speed stipulation of the storage trolley displacement drive 48 is favorably greater than the sum of all delays that occur during the operation of the splice arrangement.

If the first braking unit 54 for example brakes with a braking force of 600 N and a force of 400 N is desired by the storage trolley 42, the force difference of 200 N is supplied by the material web tension-influencing roller 37. The first braking unit 54 quasi overbrakes. The material web tension-influencing roller 37 is in effect unbraked.

The above explanations apply in the same way if the second unwinding unit 7 is currently active and the finite first material web 2 is then to be spliced to the finite second material web 5 that is coming to an end. We refer to this.

While specific embodiments of the invention have been shown and described in detail to illustrate the application of the principles of the invention, it will be understood that the invention may be embodied otherwise without departing from such principles.

What is claimed is:

1. A splice arrangement for splicing material webs, comprising:

an unwinding arrangement for unwinding one of a finite first material web from a first material roll and a finite second material web from a second material roll;

a braking arrangement for applying a braking force to at least one of the the unwinding arrangement and the finite material web being unwound;

a connection arrangement for connecting the finite first material web and the finite second material web to form an endless material web during a splice process;

a storage trolley for the uninterrupted conveying of the endless material web;

at least one material web tension-influencing device arranged before the storage trolley for influencing a web tension of the endless material web;

an actuation device in signal connection with the at least one material web tension-influencing device for actuating the at least one material web tension-influencing device; and at least one position sensor for recording a respective position of the storage trolley, wherein the at least one material web tension-influencing device actuates the storage trolley depending on the recorded position of the storage trolley.

2. The splice arrangement according to claim 1, wherein the braking force is selected in such a way that the web tension of the respective material web being unwound that prevails at the unwinding unit is greater than a target web tension of the endless material web at the storage trolley.

3. The splice arrangement according to claim 1, wherein the at least one material web tension-influencing device balances a difference between the web tension of the respective finite material web prevailing at the unwinding unit and a target web tension of the endless material web at the storage trolley.

4. The splice arrangement according to claim 1, further comprising a storage trolley displacement device for displacing the storage trolley.

5. The splice arrangement according to claim 4, wherein the storage trolley displacement device comprises at least one storage trolley displacement drive.

6. The splice arrangement according to claim 5, wherein a torque of the at least one storage trolley displacement drive equals a target value stipulation.

7. The splice arrangement according to claim 6, wherein said target value stipulation is performed by the actuation device during operation.

8. The splice arrangement according to claim 4, wherein the actuation device is in signal connection with the storage trolley displacement device for actuating the storage trolley displacement device.

9. The splice arrangement according to claim 1, wherein the at least one material web tension-influencing device one of holds the storage trolley in its zero position and displaces the storage trolley into the same by changing the web tension of the endless material web.

10. The splice arrangement according to claim 1, wherein the at least one material web tension-influencing device comprises at least one material web tension-influencing roller, which is at least one of brakeable and acceleratable, for engaging the endless material web.

11. The splice arrangement according to claim 10, wherein the at least one material web tension-influencing device comprises at least one roller drive, which is in connection with the at least one material web tension-influencing roller for at least one of accelerating and braking the at least one material web tension-influencing roller.

12. The splice arrangement according to claim 11, wherein the at least one roller drive ensures the web tension of the endless material web desired at the storage trolley.

13. The splice arrangement according to claim 11, further comprising at least one rotation speed sensor for recording a rotation speed of at least one of the at least one roller drive and the at least one material web tension-influencing roller.

14. The splice arrangement according to claim 1, wherein the actuation device is in signal connection with the braking arrangement for actuating the braking arrangement.

15. The splice arrangement according to claim 1, wherein the braking force of the braking arrangement is substantially constant across a splice process.

16. A method for splicing finite material webs, the method comprising the steps:

unwinding a finite first material web from one of a first material roll and a finite second material web from a second material roll by an unwinding arrangement;

applying a braking force to at least one of the unwinding arrangement and the finite material web being unwound by a braking arrangement;

connecting the finite first material web and the finite second material web during a splice process to form an endless material web by a connection arrangement;

influencing a web tension of the endless material web by at least one material web tension-influencing device located before a storage trolley;

actuating the at least one material web tension-influencing device by an actuation device;

providing at least one position sensor for recording a respective position of the storage trolley, wherein the at least one material web tension-influencing device actuates the storage trolley depending on the recorded position of the storage trolley.

17. The method according to claim 16, wherein said method is performed by a splice arrangement comprising:

an unwinding arrangement for unwinding one of a finite first material web from a first material roll and a finite second material web from a second material roll;

a braking arrangement for applying a braking force to at least one of the unwinding arrangement and the finite material web being unwound;

a connection arrangement for connecting the finite first material web and the finite second material web to form an endless material web during a splice process;

a storage trolley for the uninterrupted conveying of the endless material web;

at least one material web tension-influencing device arranged before the storage trolley for influencing a web tension of the endless material web; and an actuation device in signal connection with the at least one material web tension-influencing device for actuating the at least one material web tension-influencing device.

18. A method for splicing finite material webs, the method comprising the steps:

unwinding a finite first material web from one of a first material roll and a finite second material web from a second material roll by an unwinding arrangement;

applying a braking force to at least one of the unwinding arrangement and the finite material web being unwound by a braking arrangement;

connecting the finite first material web and the finite second material web during a splice process to form an endless material web by a connection arrangement;

influencing a web tension of the endless material web by at least one material web tension-influencing device located before a storage trolley;

actuating the at least one material web tension-influencing device by an actuation device, the at least one material web tension-influencing device comprising at least one material web tension-influencing roller, which is at least one of brakeable and acceleratable, for engaging the endless material web, the at least one material web tension-influencing device comprising at least one roller drive, which is in connection with the at least one material web tension-influencing roller for at least one of accelerating and braking the at least one material web tension-influencing roller; and providing at least one rotation speed sensor for recording a rotation speed of at least one of the at least one roller drive and the at least one material web tension-influencing roller.

19. A splice arrangement for splicing material webs, comprising:

an unwinding arrangement for unwinding one of a finite first material web from a first material roll and a finite second material web from a second material roll;

a braking arrangement for applying a braking force to at least one of the unwinding arrangement and the finite material web being unwound;

a connection arrangement for connecting the finite first material web and the finite second material web to form an endless material web during a splice process;

a storage trolley for the uninterrupted conveying of the endless material web;

at least one material web tension-influencing device arranged before the storage trolley for influencing a web tension of the endless material web;

an actuation device in signal connection with the at least one material web tension-influencing device for actuating the at least one material web tension-influencing device, the at least one material web tension-influencing device comprising at least one material web tension-influencing roller, which is at least one of brakeable and acceleratable, for engaging the endless material web, the at least one material web tension-influencing device comprising at least one roller drive, which is in connection with the at least one material web tension-influencing roller for at least one of accelerating and braking the at least one material web tension-influencing roller; and at least one rotation speed sensor for recording a rotation speed of at least one of the at least one roller drive and the at least one material web tension-influencing roller.

* * * * *